United States Patent [19]

Nishikawa et al.

[11] 4,423,397

[45] Dec. 27, 1983

[54] DIELECTRIC RESONATOR AND FILTER WITH DIELECTRIC RESONATOR

[75] Inventors: Toshio Nishikawa, Nagaokakyo; Youhei Ishikawa; Sadahiro Tamura, both of Kyoto; Yoji Ito, Takatsuki, all of Japan

[73] Assignee: Murata Manufacturing Co., Ltd., Nagaokakyo, Japan

[21] Appl. No.: 277,389

[22] Filed: Jun. 25, 1981

[30] Foreign Application Priority Data

Jun. 30, 1980 [JP] Japan ..... 55-89599
Jun. 30, 1980 [JP] Japan ..... 55-89600

[51] Int. Cl.[3] ..... H01P 7/10; H01P 1/208; H01P 1/209

[52] U.S. Cl. ..... 333/219; 333/202; 333/212; 333/227; 333/248

[58] Field of Search ..... 333/202, 204–212, 333/219, 248, 222–235; 331/96, 99, 107 DP, 107 SL, 107 C, 117 D

[56] References Cited

U.S. PATENT DOCUMENTS

| | | | |
|---|---|---|---|
| 3,237,132 | 2/1966 | Okaya | 333/209 X |
| 3,919,672 | 11/1975 | Plourde | 333/234 |
| 4,028,652 | 6/1977 | Wakino et al. | 333/202 X |
| 4,136,320 | 1/1979 | Nishikawa et al. | 333/82 |
| 4,138,652 | 2/1979 | Nishikawa et al. | 333/82 |
| 4,142,164 | 2/1979 | Nishikawa et al. | 333/219 X |
| 4,143,344 | 3/1979 | Nishikawa et al. | 333/202 |
| 4,321,560 | 3/1982 | Nishikawa et al. | 331/99 |
| 4,325,035 | 4/1982 | Nishikawa et al. | 331/96 |

OTHER PUBLICATIONS

Schlicke–"Quasi-Degenerated Modes in High-$\epsilon$ Dielectric Cavities", Reprinted from Journal of Applied Physics, vol. 24, No. 2, 187–191, Feb. 1953; pp. 187–191.

Karmel–"$TE_{011}$ Mode Sectorial Circular Cylindrical Cavities Filters", IEEE Trans. on Microwave Theory and Techniques, vol. MTT-28, Jul. 1980; pp. 695–699.

"Circuit Properties of Microwave Dielectric Resonators" of Arthur Kapr et al. from IEEE Transactions on Microwave Theory and Techniques, vol. MIT-16, No. 10, Oct. 1968, pp. 818–828.

"Dielectric Resonator Filters for Application in Microwave Integrated Circuits" of T. D. Iveland from IEEE Transactions on Microwave Theory and Techniques, vol. MTT-19, No. 7, Jul. 1968, pp. 643–652.

*Primary Examiner*—Marvin L. Nussbaum
*Attorney, Agent, or Firm*—Jackson, Jones & Price

[57] ABSTRACT

A dielectric resonator has a sector shape, and a filter has a signal source for emitting signal to be filtered, signal receiver for receiving the filtered signal and a path defined between the signal source and the signal receiver. At least one sector shaped dielectric resonator is disposed in the path.

28 Claims, 26 Drawing Figures

DIELECTRIC RESONATOR AND FILTER WITH DIELECTRIC RESONATOR

BACKGROUND OF THE INVENTION

The present invention relates to a dielectric resonator and also to a filter employing the dielectric resonator.

In FIG. 1, the principle of a conventional filter provided with a disc type dielectric resonator 2 which is formed by ceramic material of the titanium dioxide ($TiO_2$) family is schematically illustrated. A reference numeral 4 designates a metal casing, and the resonator 2 is hermetically disposed in the casing 4 approximately at a center portion by a support 6, also made of ceramics, such as forsterite. The operation mode is $TE_{01\delta}$. A coupling circuit includes an input means and an output means which are diagrammatically shown at 8 and 10. The size of the casing 4, particularly the dimension of the internal space is so arranged as to produce a cut-off condition at a dominant frequency. It is to be noted that the resonator 2 which is shown as having a disc shape can be arranged in a shape of a doughnut or in a shape of a polygon prism. Furthermore, the support 6 can be formed by an electrically non-conductive substrate. An external circuit (not shown) which is to be connected to the coupling circuit can be any known circuit, i.e., waveguide circuit, coaxial circuit or MIC circuit. Although the above described type of resonator has a high Q-factor, there are several disadvantages as follows;

(i) In the field of electronic parts and devices, many approaches have been made to reduce their size, and from this point of view, the size of the conventional filter is still bulky. This is due to the large configuration of the dielectric resonator, which accordingly increases the size of the casing.

(ii) When used in a high power circuit, the resonator generates a large amount of heat which is not completely transmitted to the casing, and accordingly, the temperature of the resonator increases. This results in deviation of resonant frequency and/or reduction of Q-factor.

SUMMARY OF THE INVENTION

Accordingly, it is a primary object of the present invention to provide a dielectric resonator which is compact in size and can readily be manufactured at low cost.

It is another object of the present invention to provide a filter employing the above described type dielectric resonator to reduce the configuration of the filter.

It is a further object of the present invention to provide a filter of the above described type which can effectively transmit the heat generated from the resonator to the casing to prevent an undesirable temperature increase of the resonator.

In accomplishing these and other objects, a dielectric resonator according to the present invention is presented in a shape of a sector or segment of a predetermined design configuration and a filter according to the present invention comprises signal emitting means for emitting a signal to be filtered, signal receiving means for receiving a filtered signal and a path defining means for defining a signal path between the signal emitting means and the signal receiving means. At least one dielectric resonator of the sector shape is disposed in the path.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DETAILED DESCRIPTION OF THE INVENTION

Figure 1:
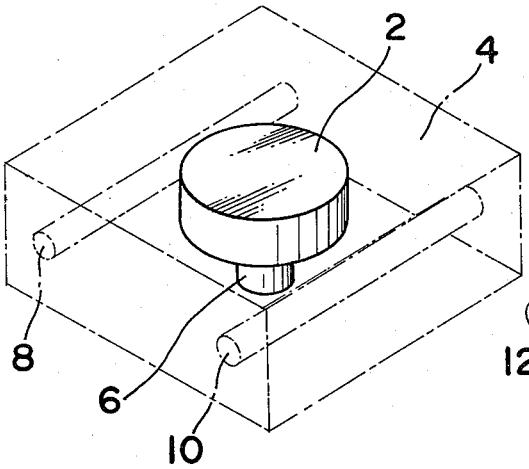
Fig. 1 Prior Art
FIG. 1 is a perspective view of a prior art resonator so accommodated in a casing to form a filter according to the prior art.
Figure 2:
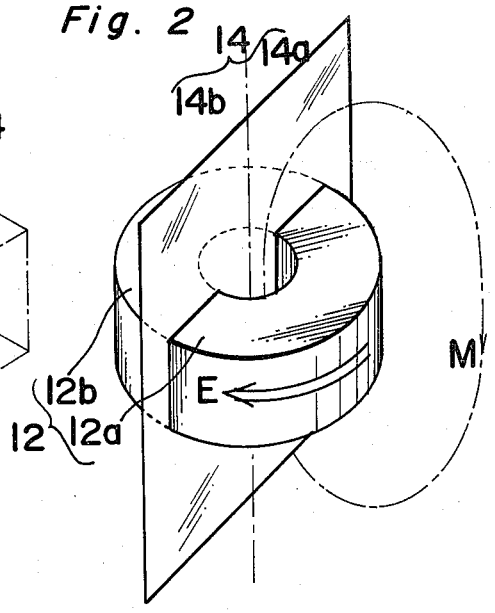
FIG. 2 is a perspective view of a resonator in general showing its operation.

Referring to FIG. 2, a dielectric resonator according to the present invention is first explained from a theoretical point of view. When a conventional doughnut type resonator 12 receives a resonant signal, a magnetic field M is produced in the form of a loop and in linked relationship with the doughnut type resonator 12 such that the lines of magnetic field M passing through the center hole of the resonator 12 extend parallel to the axis of the resonator 12 and, when viewed from the top, such lines further extend radially outward from the resonator 12. Furthermore, an electric field E is produced inside the resonator 12 in the form of loop about the center of the resonator 12. Therefore, it can be understood that the magnetic field M is in a linked relationship with the electric field E. When an imaginary plate 14 of an electrically conductive material which includes the axis of the resonator 12 is assumed, such plate 14 does not cut across any lines of magnetic field M, and accordingly, the magnetic field M will not be disturbed by the presence of such a plate 14, and neither will the electric field E. Therefore, it can be considered that the plate 14 divides the resonator 12 into two sectors 12*a* and 12*b* without disturbing the magnetic field M nor the electric field E, and that the plate 14 shields the two sectors 12*a* and 12*b* from each other. Thus, when one sector, e.g. 12*b* is removed, the other sector 12*a* provided with the plate 14 still functions as a resonator. In this case, the plate 14 touching the cut end face of the sector 12*a* is necessary to maintain the electric field E produced in the resonator, i.e., sector 12*a*. The remaining portion of the plate 14 which is not touching the cut end face of the sector 12*a* is not necessary.

Although the above example is given when the plate 14 is a plane including the axis of the resonator 12, such a plate 14 can be bent at the axis of the resonator 12. Therefore, the resonator according to the present invention can be prepared in various sectors cut by two plates 14*a* and 14*b* which intersect with each other along the axis of the resonator 12. Furthermore, the resonator before being cut, herein after referred to as a predetermined designed symmetrical base resonator, can be other than a doughnut type such as, for example, a disc type or a polygon type.

Figure 3:
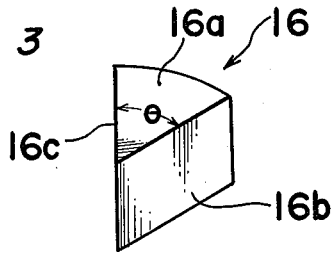
FIGS. 3 to 8 are perspective views of various types of resonators according to the present invention.

Referring to FIG. 3, there is shown an acute sector type resonator 16 of the present invention which includes a sector shaped dielectric body 16*a* cut out from a disc type base resonator and defining an acute angle between the cut end faces. The cut end faces are deposited with electrically conductive plates 16*b* and 16*c*.

Figure 4:
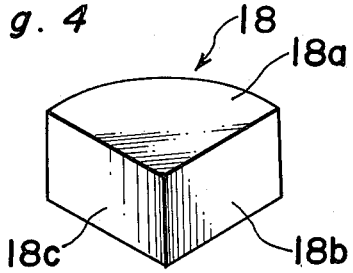

Referring to FIG. 4, there is shown a quarter sector type resonator 18 of the present invention which includes a quarter sector shaped dielectric body 18*a* cut out from a disc type base resonator and defining a right angle between the cut end faces. The cut end faces are deposited with electrically conductive plates 18*b* and 18*c*.

Figure 5:
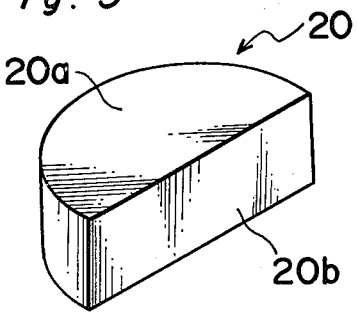

Similarly, FIG. 5 shows a half sector type resonator 20 including a half sector shaped dielectric body 20*a* cut out from a disc type base resonator and an electrically conductive plate 20*b* is deposited on a cut face. The cut face can be considered as formed by two cut end faces which define 180° about the axis of the base resonator.

Figure 6:
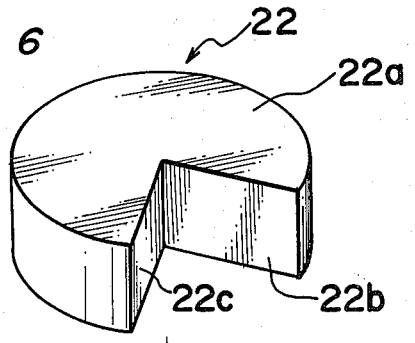

Moreover, FIG. 6 shows a V-cut sector type resonator 22 including a V-cut sector shaped dielectric body 22*a* formed from a disc type base resonator and electrically conductive plate 22*b* and 22*c* which are deposited on the cut faces. The electrically conductive plates can be formed by the deposition of thin silver film through any known method, such as printing or baking.

Figure 7:
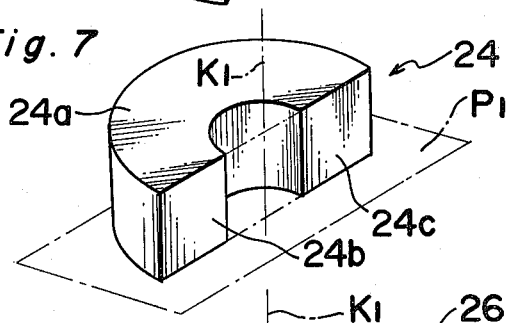
Figure 8:
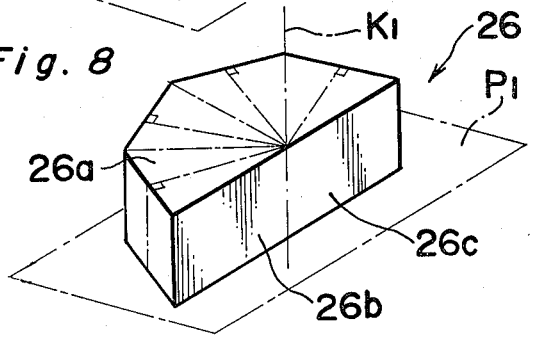

The various sector shaped resonators described above in connection with FIGS. 3 to 6 are shown merely as examples of the present invention. From a theoretical point of view, an angle $\theta$ (FIG. 3) defined between the cut faces can be any degree selected from $0° < \theta < 360°$. Furthermore, the base resonator can be any known type of resonator so long as its shape is symmetric about the center. For example, FIG. 7 shows a half sector type resonator 24 whose base resonator has a disc shape, and FIG. 8 shows a half sector type resonator 26 whose base resonator is octagon. In these half sector resonators 24 and 26, the cut faces are radially spaced equidistant from the axial position, K1, and are deposited with electrically conductive plate.

Referring particularly to FIG. 7, the dielectric resonator of the present invention whose base resonator is of a disc type or doughnut type can be generally expressed as a dielectric resonator comprising: first and second planes 24*b* and 24*c* having the same configuration to each other, said first and second planes positioned perpendicularly to an imaginary plane P1 and in revolution symmetric relation to each other about an imaginary line K1 extending perpendicularly from the imaginary plane; and a dielectric body 24*a* filling a volume defined by the rotation of the first plane 24*b* from its position to the position of the second plane 24*c* about the imaginary line K1. Stated differently, the FIG. 7 resonator can be described as comprising a dielectric member with the geometry of the member corresponding to a body with a section removed therefrom. The body, before the section is removed, is generally symmetrical about axis K1 and the removed section is defined by planes 24*b* and 24*c* which intersect along the axis. The angle defined by planes 24*b* and 24*c* can be varied between a value greater than 0° and less than 360°. For the FIG. 7 embodiment, the angle is 180°. For the FIGS. 3–6 embodiments the angles are greater than 270°, 270°, 180° and less than 90°, respectively.

Referring particularly to FIG. 8, the dielectric resonator of the present invention whose base resonator is the prism of a polygon such as an octagon can be generally expressed as a dielectric resonator comprising: first and second planes 26*b* and 26*c* having the same configuration to each other, said first and second planes positioned perpendicularly to an imaginary plane P1 and in a revolution symmetric relationship to each other about an imaginary line K1 extending from the imaginary plane P1; and a dielectric body 26*a* filling a volume defined by a plurality of right angle triangle prisms assembled together between said first and second planes 26*b* and 26*c* with the edge of each prism containing an angle smaller than 45° being aligned on said imaginary line K1. Stated differently, the FIG. 8 resonator can be described as comprising a dielectric member with the geometry of the member corresponding to a body with a section removed therefrom. The body, before the section is removed, is generally symmetrical about axis K1 and has a polygonal cross section with each side of the cross section spanning an angle about the axis of less than 45 degrees. The removed section is defined by planes 26*b* and 26*c* which intersect along axis K1 and which form an angle which can be varied between a value greater than 0° and less than 360°.

As apparent from the foregoing description, the sector shaped resonator according to the present invention can be prepared in a compact size, and accordingly, the dielectric material needed to form such sector resonators can be reduced. Therefore, the manufacturing cost can be reduced.

Figure 9:
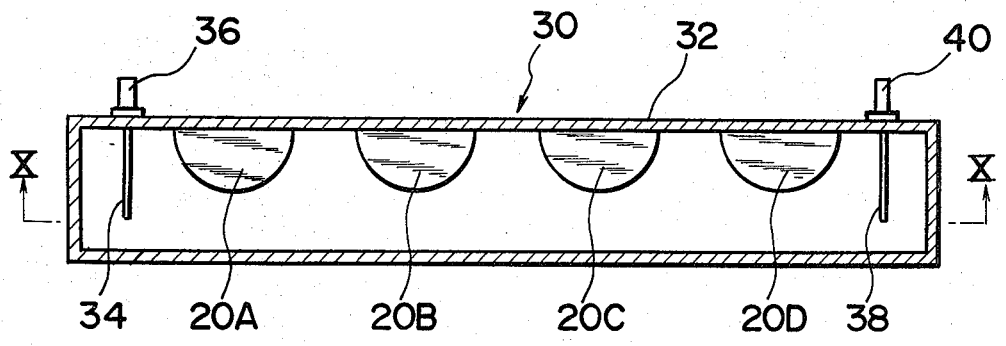
FIG. 9 is a cross sectional view taken along a line IX—IX shown in FIG. 10 and showing a filter according to the first embodimemnt of the invention.
Figure 10:
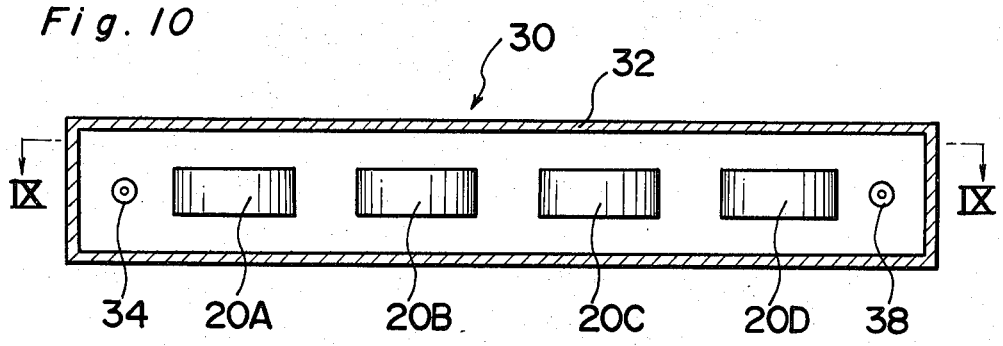
FIG. 10 is a cross sectional view taken along a line X—X shown in FIG. 9.

Referring to FIGS. 9 and 10, there is shown a filter 30 employing four half sector resonators 20A, 20B, 20C and 20D. The filter 30 comprises an elongated shield casing 32 having its inner dimension so designed as to present a cut off characteristic at a predetermined frequency. An exciting rod 34 is provided inside the casing 32 at one end portion thereof in a perpendicular relationship to the long axis of the casing 32. A socket 36 is provided on the outside of the casing 32 for connecting the exciting rod 34 with a coaxial cable (not shown). Similarly, a receiving rod 38 coupled with a socket 40 is provided at the other end portion of the casing 32. The half sector resonators 20A to 20D are bonded on one inner surface of the casing 32 in alignment with each other between the rods 34 and 38 with a predetermined pitch spaced from each other and the curved surface being projecting towards an opposite inner surface. The pitch of the resonators is with axis K1 generally perpendicular with respect to the signal path. Furthermore, a plane defined between the rods 34 and 38 intercepts the center of opposite flat faces of each half sector resonator so as to effectively resonate each resonator. The bonding of the half sector resonators 20A to 20D can be carried out by the use of a bonding agent between the inner wall of the casing 32 from which the rods 34 and 38 extend and the face of the half sector resonator deposited with the plate.

In operation, an input signal emitted from the rod 34 is transferred through the space inside the casing 32 to the first half sector resonator 20A, and from which the resonant signal is emitted, resulting in filtering of a signal (resonant signal) to a certain degree. Since the half sector resonators 20A to 20D have the same characteristic, the signal is further filtered as it passes through the half sector resonators, and when it reaches the receiving rod 38, a filtered output signal is taken out from the socket 40. As apparent from the above, an increase in the number of the segmented resonator members increases the filtering effect. Therefore, the number of the resonator members, which has been explained as four, can be changed to any desired number.

Figure 25:
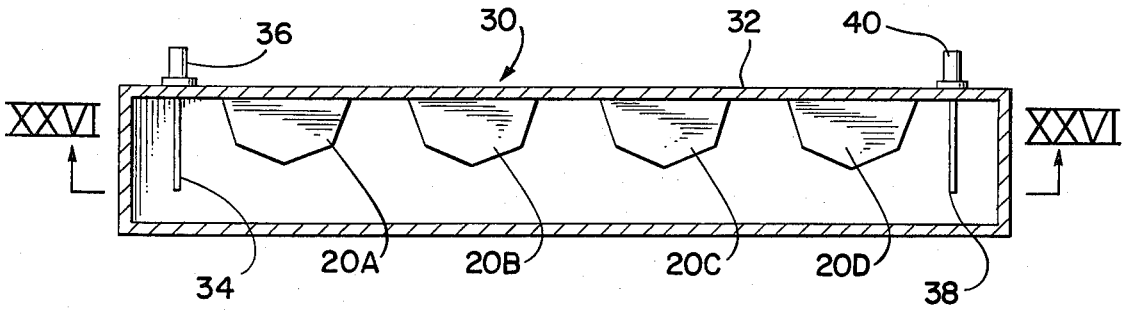
FIG. 25 is a cross sectional view taken along line XXVI—XXVI shown in FIG. 26 and shows a filter of a further embodiment of the invention.
Figure 26:
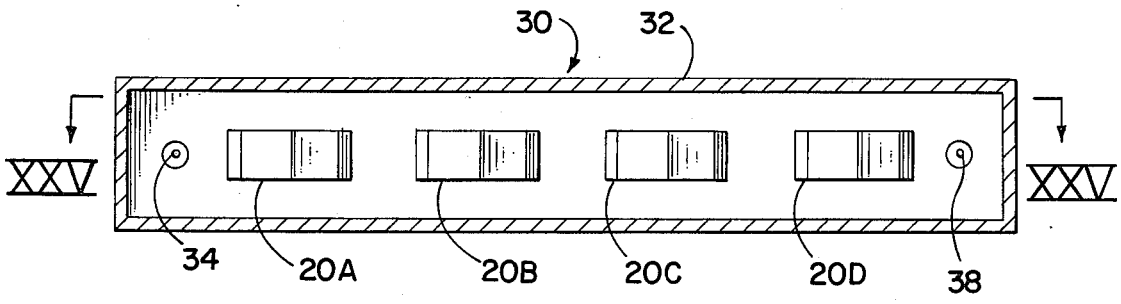
FIG. 26 is a cross sectional view taken along line XXV—XXV shown in FIG. 25.

Referring to FIGS. 25 and 26, there is shown a filter 30 similar to the filter depicted in FIGS. 9 and 10 with the exception that the four half sector resonators 20A, 20B, 20C and 20D are derived from a base resonators having polygonal rather than circular cross sections.

Figure 11:
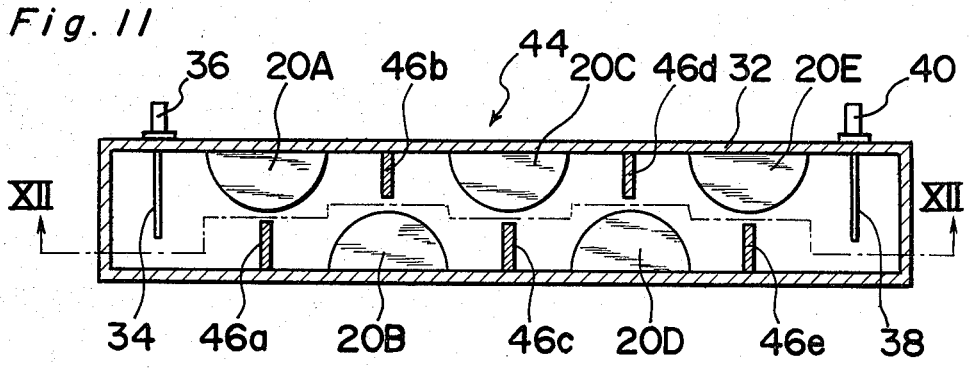
FIG. 11 is a cross sectional view taken along a line XI—XI shown in FIG. 12 and showing a filter according to the second embodiment of the invention.
Figure 12:
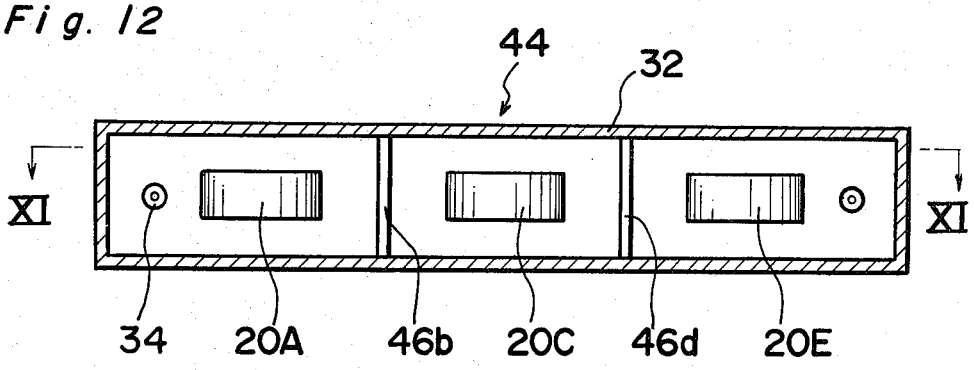
FIG. 12 is a cross sectional view taken along a line XII—XII shown in FIG. 11.

Referring to FIGS. 11 and 12, there is shown a filter 44 according to the second embodiment. The filter 44 comprises shield casing 32, exciting rod 34 coupled with a socket 36 and receiving rod 38 coupled with a socket 40, which are arranged in a similar manner to the first embodiment. The filter 44 further comprises five half sector resonators 20A to 20E which are bonded on opposite inner surfaces of the casing 32. More specifically, three half sector resonators 20A, 20C and 20E are bonded to one inner surface of the casing 32 in a similar manner described above but with a longer pitch, and two half sector resonators 20B and 20D are bonded to the opposite inner surface in an offset relationship with the resonators 20A, 20B and 20C, such that the half sector resonator 20B is positioned approximately between the half sector resonators 20A and 20C and the half sector resonator 20D is positioned approximately between the half sector resonators 20C and 20E. Furthermore, there are provided a plurality of walls **46*a* to 46*e* made of electrically conductive material to guide the signal transmitted through the casing 32. For example, the wall 46*a* prevents the signal emitted from the exciting rod 34 from being transmitted directly to the second half sector resonator 20B, and accordingly, the signal from the rod 34 is guided to the first half sector resonator 20A. The walls 46*a* and 46*b* guide the signal from the first half sector resonator 20A to the second half sector resonator 20B**. According to the second embodiment, the signal is transmitted rather in a zig-zag format.

Figure 13:
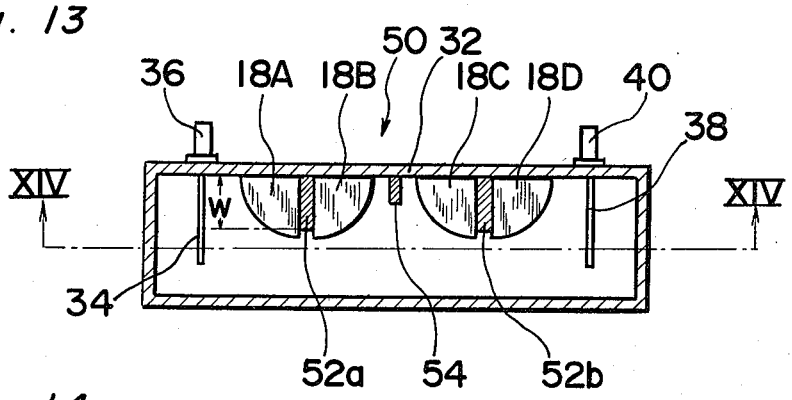
FIG. 13 is a cross sectional view taken along a line XIII—XIII shown in FIG. 14 and showing a filter according to the third embodiment of the invention.
Figure 14:
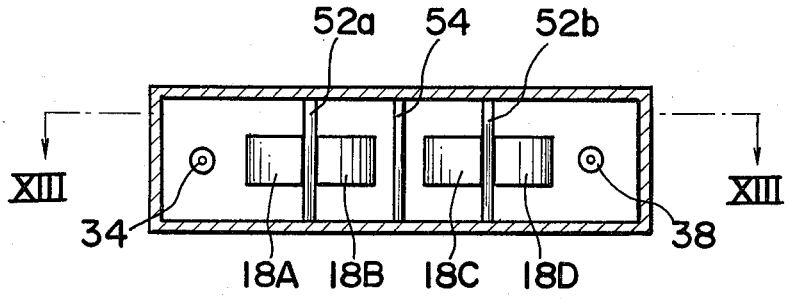
FIG. 14 is a cross sectional view taken along a line XIV—XIV shown in FIG. 13.

Referring to FIGS. 13 and 14, there is shown a filter 50 according to the third embodiment of the present invention. The filter 50 comprises shield casing 32, exciting rod 34, socket 36, receiving rod 38 and socket 40 which are arranged in a similar manner described above. The filter 50 further comprises four quarter sector resonators 18A, 18B, 18C and 18D which are bonded to one inner surface of the casing 32 such that one cut face provided with the plate **18*b* (FIG. 4) is bonded to the inner surface and the other cut face provided with the plate 18*c* is bonded to a wall 52*a* which is projecting inwardly and perpendicularly from said one inner surface. The quarter sector resonators 18A and 18B are positioned side-by-side to define a semicircle theretogether. Similarly, the quarter sector resonators 18C and 18D are positioned side-by-side through a wall 52*b* to define a semicircle theretogether. A wall 54 is provided between the resonators 18B and 18C for adjusting the coupling between the resonators 18B and 18C. These walls 52*a* and 52*b*** are made of an electrically conductive material.

According to a preferred embodiment, the width W (FIG. 13) of the wall **52*a* or 52*b* should be slightly smaller than the radius of the quarter sector resonator to improve the coupling between the neighboring resonators, e.g., 18A and 18B**.

In operation, a signal emitted from the rod 34 is transferred to the first quarter sector resonator 18A, and then the signal is further transferred to the next quarter sector resonator 18B through the air. Likewise, the signal is transferred in turn to the resonators 18C and 18D and when it reaches the rod 38, the filtered signal is taken out from the socket 40.

Figure 15:
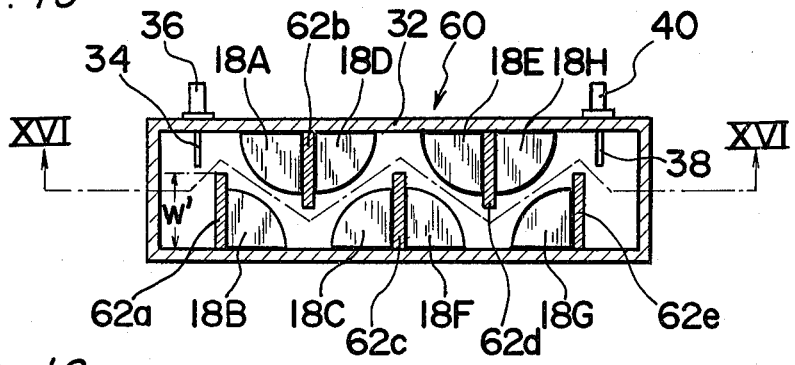
FIG. 15 is a cross sectional view taken along a line XV—XV shown in FIG. 16 and showing a filter according to the fourth embodiment of the invention.
Figure 16:
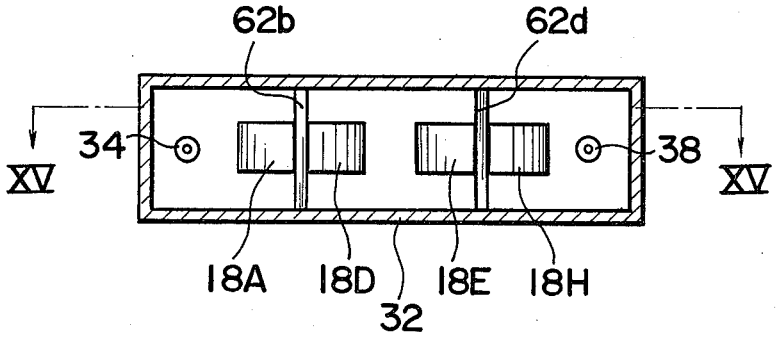
FIG. 16 is a cross sectional view taken along a line XVI—XVI shown in FIG. 15.

Referring to FIGS. 15 and 16, there is shown a filter 60 according to the fourth embodiment of the present invention. This filter 60 also has the casing 32, exciting rod 34, socket 36, receiving rod 38 and socket 40 which are arranged in a similar manner described above. The filter 60 further has eight quarter sector resonators 18A to 18H in which the quarter sector resonators 18A, 18D, 18E and 18H are bonded on one inner surface in a similar manner to the four quarter sector resonators provided in the filter 50 of the third embodiment. The remaining resonators 18B, 18C, 18F and 18G are bonded on the opposite inner surface in an offset relationship with the opposing resonators 18A, 18D, 18E and 18H, respectively. There are provided walls **62*a*, 62*b*, 62*c*, 62*d* and 62*e* for improving the shielding effect between the neighboring resonators, e.g., 18A and 18D and further for guiding the signal. For this purpose, the width W′ of the walls 62*a* to 62*e*** is greater than the radius of the quarter sector resonator.

In operation, the signal emitted from the rod 34 is transferred via resonators in the order of 18A, 18B, 18C, 18D, 18E, 18F, 18G and 18H, to the receiving rod 38, and the resulting signal is taken out from the socket 40.

Figure 17:
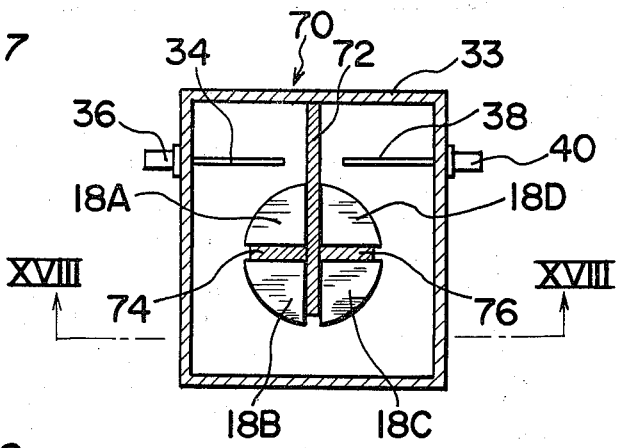
FIG. 17 is a cross sectional view taken along a line XVII—XVII shown in FIG. 18 and showing a filter according to the fifth embodiment of the invention.
Figure 18:
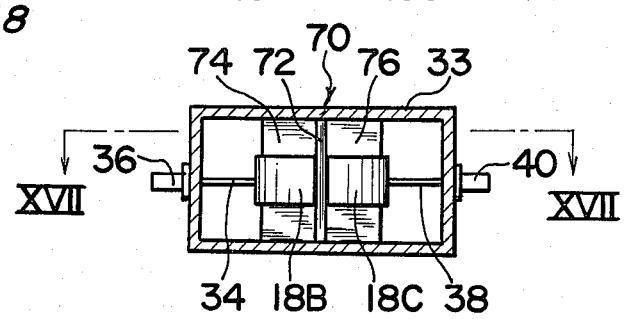
FIG. 18 is a cross sectional view taken along a line XVIII—XVIII shown in FIG. 17.

Referring to FIGS. 17 and 18, there is shown a filter 70 according to the fifth embodiment of the present invention. The filter 70 comprises a casing 33 having approximately a square configuration when viewed from the top, and a partition wall 72 made of electrically conductive material and extending from the center of one inner surface towards the opposite inner surface of the casing with a predetermined distance spaced between the end of the partition wall remote from said one inner surface and said opposite inner wall to allow signals to pass therethrough. A pair of plates 74 and 76 made of electrically conductive material and extending perpendicular from the partition wall 72 are provided such that the partition wall 72 and the plates 74 and 76 define a cross shaped configuration approximately at the center of the casing 33. When viewed from the side as shown in FIG. 18, the partition wall 72 and the plates 74 and 76 extend from the top plate to the bottom plate of the casing 33. The exciting rod 34, which is coupled with the socket 36, is located on one side of the partition wall 72 adjacent to the surface from which the partition wall 72 extends, and extends perpendicularly to the partition wall 72. The receiving rod 38 coupled with the socket 40 is located on the other side of the partition wall 72 approximately in alignment with the exciting rod 34. In the casing 33 there are provided four quarter sector resonators 18A, 18B, 18C and 18D which are bonded to the four corners defined by the cross such that the faces of each quarter sector resonator containing the right angle are fixedly bonded to each corner of the cross.

In operation, the signal emitted from the exciting rod 34 is transferred to the quarter sector resonators in the order of 18A, 18B, 18C and 18D through the space around the resonators and further to the receiving rod 38.

Figure 19:
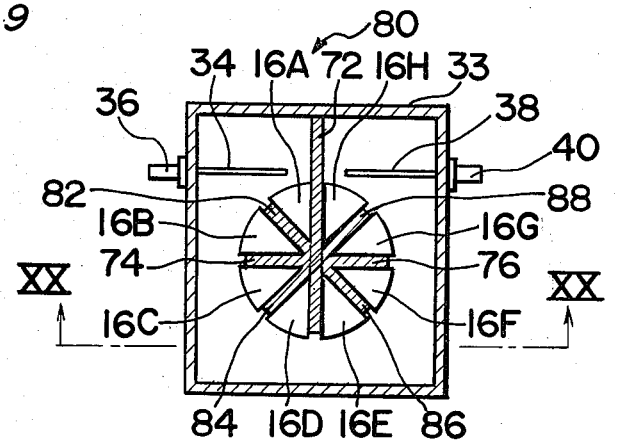
FIG. 19 is a cross sectional view taken along a line XIX—XIX shown in FIG. 20 and showing a filter according to the sixth embodiment of the invention.
Figure 20:
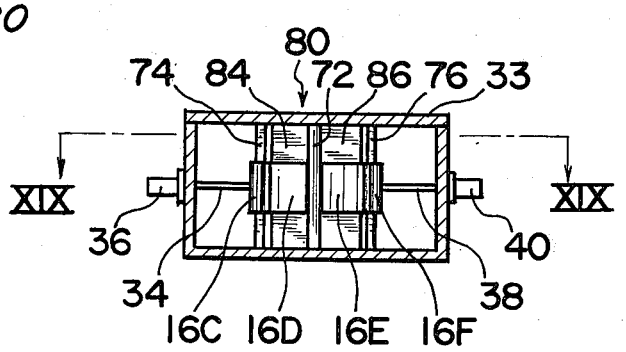
FIG. 20 is a cross sectional view taken along a line XX—XX shown in FIG. 19.

Referring to FIGS. 19 and 20, there is shown a filter 80 according to the sixth embodiment of the present invention. When compared with the filter 70 of the fifth embodiment, the filter 80 further comprises electrically conductive plates 82, 84, 86 and 88 extending radially from the crossing point of the partition wall 72 and the plates 74 and 76 so as to define eight corners each containing an angle of 45°. Provided in the corners are eight acute sector resonators 16A, 16B, 16C, 16D, 16E, 16F, 16G and 16H. Accordingly, the signal emitted from the rod 34 is transferred through the acute sector resonators in said order to the receiving rod 38.

Figure 21:
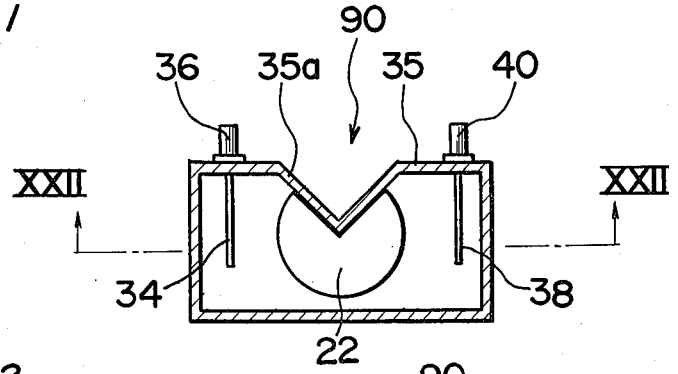
FIG. 21 is a cross sectional view taken along a line XXI—XXI shown in FIG. 22 and showing a filter according to the seventh embodiment of the invention.
Figure 22:
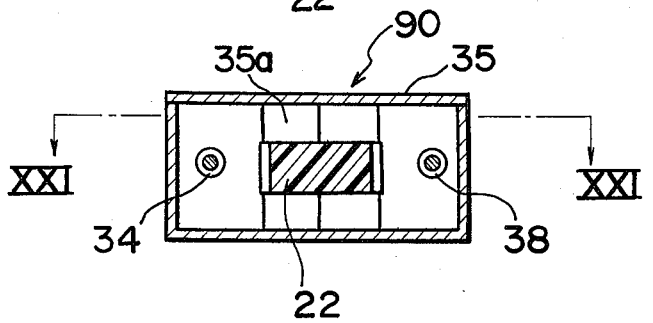
FIG. 22 is a cross sectional view taken along a line XXII—XXII shown in FIG. 21.

Referring to FIGS. 21 and 22, there is shown a filter 90 according to the seventh embodiment of the present invention. The filter 90 comprises a casing 35 having a V-shaped groove portion **35*a* which is recessed inwardly when viewed from the top (FIG. 21) and extends from top to bottom of the casing 35 (FIG. 22) so as to present a V-shaped projection inside the casing. Fittingly bonded on the V-shaped projection is a complimentary V-cut sector resonator 22. The exciting rod 34 and the receiving rod 38 are positioned on the opposite sides of the resonator 22 so that the signal emitted from the rod 34 is filtered in the resonator 22 and is taken from the receiving rod 38**.

In the above described embodiment one through seven, the attachment of the sector resonator to the inner surface or to the wall can be carried out, instead of using the bonding agent, by the method of soldering.

Furthermore, in any one of the embodiments, since the casing is made of an electrically conductive material, it is not necessary to provide plate e.g. **16*c* and 16*b* (FIG. 3) to the cut faces of the resonator. Therefore, the sector shaped dielectric body, e.g., 16** can be directly bonded to the wall or inner surface of the casing.

According to the present invention, since the resonator can be formed in a compact size, the filter can also be formed in a compact size. Particularly, in the embodiments described in connection with FIGS. 17 to 22, the signal propagates through a passageway having a figure of a "U", and accordingly, the length of the casing can be shortened.

Furthermore, since the resonators are held in contact with the casing with a considerably large contact area, the heat generated in the resonators can be effectively transmitted to the casing. Accordingly, when filtering a signal of a large power of signal, the heat generated from the resonator can be dissipated through the casing to maintain the temperature of the resonator considerably low, and accordingly, the undesired change of resonant characteristic caused by the temperature change can be avoided. The effect of such heat dissipation is particularly noticeable when the resonators are attached to partition wall 72 and plates 74 and 76 which function as heat dissipation fins.

Figure 23:
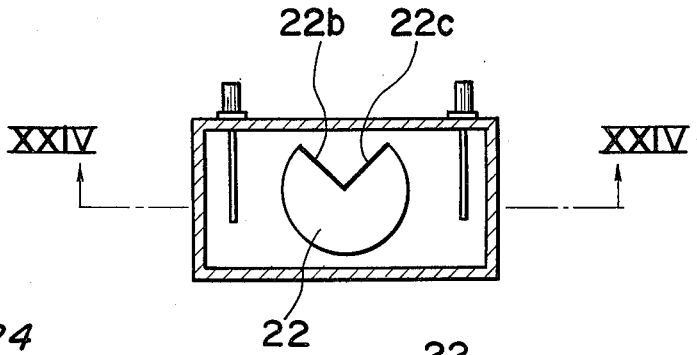
FIG. 23 is a cross sectional view taken along a line XXIII—XXIII shown in FIG. 24 and showing a modified filter.
Figure 24:
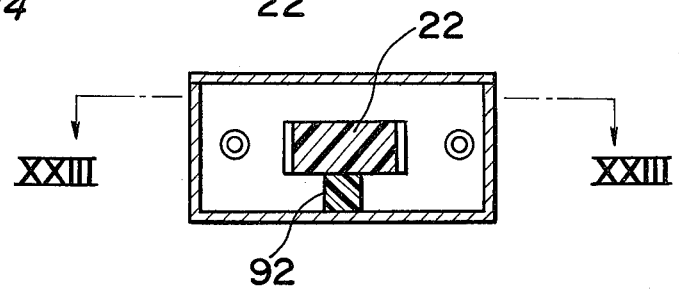
FIG. 24 is a cross sectional view taken along a line XXIV—XXIV shown in FIG. 23.

Instead of bonding on the inner wall or plates, the sector shaped resonator according to the present invention can be mounted on a dielectric support 92 as shown in FIG. 24. In this case, the cut face of the resonator should be coated with an electrically conductive film **22*b* and 22*c*, as shown by the bold line in FIG. 23**.

Although the present invention has been fully described by way of examples with reference to the accompanying drawings, many modifications and variations thereof will now be apparent to those skilled in the art, and the scope of the present invention is therefore to be limited not by the details of the preferred embodiments described above, but only by the terms of appended claims.

What is claimed is:

1. A dielectric resonator comprising dielectric member, the geometry of said member corresponding to a body with a section removed therefrom, said body being generally symmetrical about an axis and said section being defined by two planes which intersect along said axis and form an angle greater than 0 degrees.

2. The dielectric resonator of claim 1 further comprising electrically conductive material on surfaces of said dielectric member which are defined by said planes.

3. The dielectric resonator of claim 2 wherein said angle formed by said planes is approximately a right angle.

4. The dielectric resonator of claim 2 wherein said angle formed by said planes is approximately 180 degrees.

5. The resonator of claim 2 wherein said angle formed by said planes is approximately 270 degrees.

6. The resonator of claim 2 wherein said angle formed by said planes is at least approximately 270 degrees.

7. The resonator of claim 1 wherein said symmetrical body has a polygonal cross section.

8. The resonator of claim 7 further comprising electrically conductive material on surfaces of said dielectric member which are defined by said planes.

9. The resonator of claim 7 wherein each side of said polygonal cross section spans an angle around said axis of less than 45 degrees.

10. A filter comprising:

signal emitting means for emitting a signal to be filtered;

signal receiving means for receiving a filtered signal;

path defining means for defining a signal path between said signal emitting means and said signal receiving means; and at least one dielectric resonator disposed in said signal path, said resonator including a dielectric member, with the geometry of said member corresponding to a body with a section removed therefrom, said body being generally symmetrical about an axis and said section being defined by two planes which intersect along said axis and form an angle greater than 0 degrees.

11. The filter of claim 10 wherein said path defining means comprises a shield casing fabricated from an electrically conductive material.

12. The filter of claim 11 wherein said shield casing has an elongated configuration, said signal emitting means is positioned inside and at one end portion of said shield casing and said signal receiving means is positioned inside and at an end portion opposite said one end of said shield casing.

13. The filter of claim 12 wherein said angle formed by said planes is 180 degrees.

14. The filter of claim 13 wherein surfaces of said dielectric member which are defined by said planes are attached to an inner surface of said casing at an intermediate position between said one and said opposite end portions.

15. The filter of claim 14 wherein there are a plurality of said dielectric resonators, each of which is attached to one inner surface of said shield casing at a predetermined angle with respect to said signal path.

16. The filter of claim 15 wherein said axis of said body of each of said resonators is generally perpendicular with respect to said signal path.

17. The filter of claim 14 wherein said at least one dielectric resonator comprises 2 N+1 resonators with N+1 resonators being attached to one inner surface of said shield casing at a predetermined angle with respect to said signal path and N resonators being attached to a surface opposite said one inner surface at said predetermined angle and offset from said N+1 resonators on said one inner surface.

18. The filter of claim 17 wherein said axis of said body of each of said 2 N+1 resonators is generally perpendicular with respect to said signal path.

19. The filter of claim 18 further comprising 2 N+1 walls made of an electrically conductive material with N+1 walls being attached to said opposite inner surface of said shield casing with one of said N+1 walls being positioned opposite each of said N+1 resonators and with N walls being attached to said one inner surface of said shield casing with one of said N walls being positioned opposite each of said N resonators.

20. The filter of claim 12 further comprising at least one wall made of an electrically conductive material extending perpendicularly from one inner surface of said casing so as to form a plurality of right angle resonator receiving positions with said casing and said at least one dielectric resonator comprises a plurality of resonators with said angle of said planes of said resonators is equal to approximately 270 degrees and with one of said resonators being disposed in each of said receiving positions.

21. The filter of claim 11 further comprising a first wall made of an electrically conductive material extending from one inner surface of said shield casing towards an opposite inner surface of said casing with an end of said first wall spaced apart from said opposite inner surface and with said signal emitting means and said signal receiving means being positioned on opposite sides of said first wall and at least one second wall made of an electrically conductive material extending from said first wall so that said first and second walls define a plurality of resonator receiving positions which are spaced apart from said one inner wall and wherein said at least one dielectric resonator comprises a plurality of resonators with one of said resonators being disposed in each of said resonator receiving positions.

22. The filter of claim 21 wherein said at least one second wall comprises two walls extending from opposite sides of said first wall so as to define four right angle resonator receiving positions and said at least one dielectric resonator comprises four resonators with said angle of said planes of said resonators is equal to approximately 270 degrees.

23. The filter of claim 21 wherein said at least one second wall comprises six walls extending from said first wall so as to define eight resonator receiving positions of 45 degrees each and said at least one dielectric resonator comprises eight resonators with said angle of said planes of said resonators being greater than 270 degrees.

24. The filter of claim 11 wherein said shield casing further comprises a projection made of an electrically conductive material which has a V-shaped cross section and which extends from one inner surface of said casing intermediate said signal emitting and receiving means and wherein an angle of said projection is substantially equal to said angle defined by said planes of said resonator and said resonator is positioned in said casing with resonator surfaces defined by said planes positioned adjacent said projection.

25. The filter of claim 12 further comprising a support for said at least one dielectric resonator extending from one inner surface of said casing so that said resonator is spaced apart from said casing and an electrically conductive material on surfaces of said dielectric resonator which are defined by said planes.

26. A filter comprising:

signal emitting means for emitting a signal to be filtered;

signal receiving means for receiving a filtered signal;

path defining means for defining a signal path between said signal emitting means and said signal receiving means; and at least one dielectric resonator dipsosed in said signal path, said resonator including a dielectric member with the geometry of said member corresponding to a body with a section removed therefrom, said body being symmetrical about an axis and having a polygonal cross section and said section being defined by two planes which intersect along said axis and form an angle of at least 0 degrees.

27. The filter of claim 26 wherein each side of said polygonal cross section spans an angle around said axis less than 45 degrees.

28. A filter comprising:

signal emitting means for emitting a signal to be filtered;

signal receiving means for receiving a filtered signal;

path defining means for defining a generally U-shaped signal path between said signal emitting means and said signal receiving means;

a plurality of dielectric resonators disposed in said U-shaped signal path, each of said resonators including a dielectric member with the geometry of said member corresponding to a body with a section removed therefrom, said body being generally symmetrical about an axis and said section being defined by two planes which intersect along said axis and form an angle of greater than 0 degrees.

* * * * *